US009976725B2

(12) United States Patent
Ryu et al.

(10) Patent No.: US 9,976,725 B2
(45) Date of Patent: May 22, 2018

(54) SOLID-STATE LUMINAIRE WITH PIXELATED CONTROL OF LIGHT BEAM DISTRIBUTION

(71) Applicants: Seung Cheol Ryu, Marblehead, MA (US); Michael Quilici, Essex, MA (US)

(72) Inventors: Seung Cheol Ryu, Marblehead, MA (US); Michael Quilici, Essex, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 8 days.

(21) Appl. No.: 14/032,856

(22) Filed: Sep. 20, 2013

(65) Prior Publication Data

US 2015/0085481 A1 Mar. 26, 2015

(51) Int. Cl.
*F21K 99/00* (2016.01)
*F21V 15/01* (2006.01)
(Continued)

(52) U.S. Cl.
CPC ..... *F21V 14/06* (2013.01); *F21S 8/026* (2013.01); *F21S 8/046* (2013.01); *F21S 8/06* (2013.01);
(Continued)

(58) Field of Classification Search
CPC ..... F21K 9/58; F21V 14/06; F21V 23/005; F21V 29/2268; F21V 15/01
See application file for complete search history.

(56) References Cited

U.S. PATENT DOCUMENTS 6,392,368 B1 * 5/2002 Deller et al. ..... 315/317
7,382,976 B1 * 6/2008 Mok ..... G02B 3/14 257/100
(Continued)

FOREIGN PATENT DOCUMENTS

GB 2374919 A 10/2002
KR 20090000762 1/2009
(Continued)

OTHER PUBLICATIONS

Martinez Orta, Maxima, International Search Report and Written Opinion of the International Search Authority for PCT/US2015/058539, dated Mar. 17, 2016, European Patent Office, Rijswijk, The Netherlands (11 pages).
(Continued)

*Primary Examiner* — Elmito Breval
(74) *Attorney, Agent, or Firm* — Yutian Ling

(57) ABSTRACT

A luminaire having an electronically adjustable light beam distribution is disclosed. In some embodiments, the disclosed luminaire includes a plurality of solid-state lamps mounted on one or more surfaces of a housing. The lamps can be electronically controlled individually and/or in conjunction with one another, for example, to provide highly adjustable light emissions from the luminaire (e.g., pixelated control over light distribution). In some cases, a given solid-state lamp may include tunable electro-optic componentry to provide it with its own electronically adjustable light beam. One or more heat sinks optionally may be mounted on the housing to assist with heat dissipation for the solid-state lamps. The luminaire can be configured to be mounted or as a free-standing lighting device, in accordance with some embodiments. In some embodiments, the aperture through which the lamps provide illumination is smaller
(Continued)

than the distribution area of the solid-state lamps of the luminaire.

21 Claims, 7 Drawing Sheets

(51) Int. Cl.

| | |
|---|---|
| ***F21V 29/00*** | (2015.01) |
| ***F21V 14/06*** | (2006.01) |
| ***H05B 33/08*** | (2006.01) |
| ***F21S 8/02*** | (2006.01) |
| ***F21V 29/76*** | (2015.01) |
| ***F21S 8/04*** | (2006.01) |
| ***F21S 8/06*** | (2006.01) |
| ***F21V 23/04*** | (2006.01) |
| *F21Y 115/10* | (2016.01) |
| *F21Y 107/10* | (2016.01) |
| *F21Y 107/20* | (2016.01) |
| *F21L 4/00* | (2006.01) |
| *F21S 6/00* | (2006.01) |

(52) U.S. Cl.
CPC ..... *F21V 23/045* (2013.01); *F21V 23/0435* (2013.01); *F21V 29/767* (2015.01); *H05B 33/0842* (2013.01); *H05B 33/0857* (2013.01); *F21L 4/00* (2013.01); *F21S 6/00* (2013.01); *F21V 23/0478* (2013.01); *F21V 23/0485* (2013.01); *F21Y 2107/10* (2016.08); *F21Y 2107/20* (2016.08); *F21Y 2115/10* (2016.08)

(56) References Cited

U.S. PATENT DOCUMENTS

2002/0181231 A1* 12/2002 Luk ..... 362/240
2005/0117332 A1* 6/2005 Maack ..... 362/147
2006/0187654 A1* 8/2006 Jungel-Schmid et al. .... 362/147
2007/0285921 A1* 12/2007 Zulim et al. ..... 362/240
2009/0288340 A1* 11/2009 Hess ..... 47/58.1 LS
2010/0046226 A1 2/2010 Cox et al.
2010/0157594 A1* 6/2010 Yang et al. ..... 362/235
2010/0165618 A1* 7/2010 Vissenberg et al. ..... 362/231
2011/0051420 A1 3/2011 Gill
2011/0113640 A1 5/2011 Molina
2011/0199770 A1* 8/2011 Pedersen ..... 362/249.03
2011/0211110 A1* 9/2011 Doublet ..... H04N 7/188 348/370
2011/0235350 A1* 9/2011 Kessler ..... 362/471
2012/0026732 A1 2/2012 Fricke
2012/0081005 A1* 4/2012 Lin et al. ..... 315/86
2012/0112661 A1 5/2012 van de Ven et al.
2012/0169953 A1 7/2012 Kataoka et al.
2012/0206050 A1* 8/2012 Spero ..... 315/152
2012/0206918 A1 8/2012 Lee et al.
2014/0160744 A1 6/2014 Wimberly
2014/0175966 A1 6/2014 Tan

FOREIGN PATENT DOCUMENTS

WO 0124583 A1 4/2001
WO 2007125520 A1 11/2007
WO WO 2007125520 A1 * 11/2007
WO 2008152561 A1 12/2008

OTHER PUBLICATIONS

Prouteau, Evelyne, International Search Report and Written Opinion of the International Searching Authority, for counterpart application PCT/US2015/058540, dated Jan. 4, 2016, European Patent Office, Rijswijk, The Netherlands, 12 pages.
Prouteau, Evelyne, International Search Report and Written Opinion of the International Search Authority for PCT/US2015/058537, dated Jan. 11, 2016, European Patent Office, Rijswijk, The Netherlands (12 pages).

* cited by examiner

SOLID-STATE LUMINAIRE WITH PIXELATED CONTROL OF LIGHT BEAM DISTRIBUTION

CROSS-REFERENCE TO RELATED APPLICATIONS

This application is related to U.S. patent application Ser. No. 14/032,821, filed on Sep. 20, 2013, which is herein incorporated by reference in its entirety.

FIELD OF THE DISCLOSURE

The present disclosure relates to solid-state lighting (SSL) fixtures and more particularly to light-emitting diode (LED)-based luminaires.

BACKGROUND

Traditional adjustable lighting fixtures, such as those utilized in theatrical lighting, employ mechanically adjustable lenses, track heads, gimbal mounts, and other mechanical parts to adjust the angle and direction of the light output thereof. Mechanical adjustment of these components is normally provided by actuators, motors, or manual adjustment by a lighting technician.

Figure 1A:
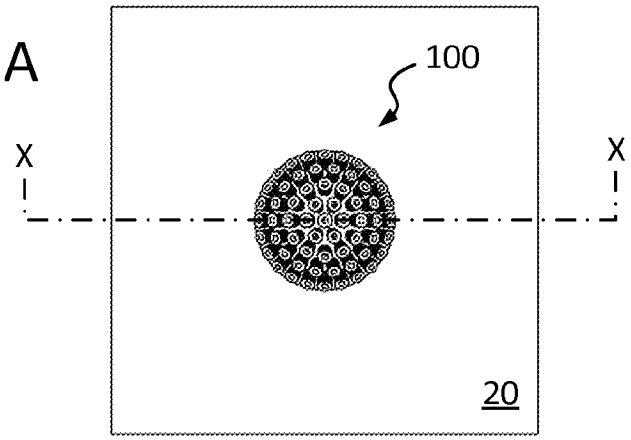
FIG. 1A is a top-down view of a luminaire configured in accordance with an embodiment of the present disclosure.

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

A luminaire having an electronically adjustable light beam distribution is disclosed. In some embodiments, the disclosed luminaire includes a plurality of solid-state lamps mounted on one or more surfaces of a housing. The lamps can be electronically controlled individually and/or in conjunction with one another, for example, to provide highly adjustable light emissions from the luminaire. In some cases, a given solid-state lamp may include tunable electro-optic componentry to provide it with its own electronically adjustable light beam. In some cases, light emitted by the plurality of solid-state lamps may exhibit a one-to-one mapping of the solid-state lamps to beam spots produced thereby, allowing for pixelated control (discussed herein) over light distribution of the luminaire. In some instances, one or more heat sinks optionally may be mounted on the housing to assist with heat dissipation for the solid-state lamps. The luminaire can be configured to be mounted on a surface, such as a drop ceiling tile or wall, among others, or can be a free-standing lighting device, such as a desk lamp or torchiére lamp, in accordance with some embodiments. In some embodiments, the aperture through which the lamps provide illumination is smaller than the distribution area of the solid-state lamps of the luminaire. Numerous configurations and variations will be apparent in light of this disclosure.

General Overview

As previously noted, existing lighting designs rely upon mechanical movements for adjusting light distribution. However, these designs generally include relatively large components, such as those used in theater lighting. Also, the cost of such systems is normally high given the complexity of the mechanical equipment required to provide the desired degree of adjustability and given that lighting technicians are normally required to mechanically operate such systems. Furthermore, there is a safety concern associated with the need to manually adjust, repair, and replace components of these types of systems, particularly in areas which are normally out-of-reach without the use of a ladder, scaffolding, or aerial work platform, for example.

Thus, and in accordance with an embodiment of the present disclosure, a luminaire having an electronically adjustable light beam distribution is disclosed. In some embodiments, the disclosed luminaire includes a plurality of solid-state lamps arranged on one or more interior surfaces of a housing. In some other embodiments, the plurality of solid-state lamps may be arranged on one or more exterior surfaces of the housing. In some cases, each lamp of the luminaire may include one or more light-emitting diodes (LEDs) and tunable electro-optic componentry configured to provide that lamp with its own electronically adjustable light beam. Also, in some cases, the disclosed luminaire may be configured to direct its emissions through additional optical componentry (e.g., such as a Fresnel lens or other fixed optics disposed in an aperture, for example, to modify the beam distributions), as discussed below. One or more optional heat sinks may be mounted, for example, on the housing and coupled with the solid-state lamps to assist with thermal management of the LEDs. In some cases, an optional support plate also may be coupled with the housing and may contribute further to thermal management. In some embodiments, the aperture through which the lamp beams are provided is smaller than the field of lamps distributed across the housing (e.g., smaller than the lamp distribution area). As will be appreciated in light of this disclosure, such a design allows for great flexibility with respect to lighting direction and distribution in a relatively compact lighting fixture.

In accordance with some embodiments, the disclosed luminaire can be communicatively coupled with a controller which can be used to electronically control the output of the LEDs individually and/or in conjunction with one another (e.g., as an array or partial array), thereby electronically controlling the output of the luminaire as a whole. In some such cases, a luminaire controller configured as described herein may provide for electronic adjustment, for example, of the beam direction, beam angle, beam distribution, and/or beam diameter for each lamp or some sub-set of the available lamps, thereby allowing for customizing the spot size, position, and/or distribution of light on a given surface of incidence. In some cases, the disclosed luminaire controller may provide for electronic adjustment, for example, of the brightness (dimming) and/or color of light, thereby allowing for dimming and/or color mixing/tuning, as desired. In a more general sense, and in accordance with an embodiment, the properties of the light output of a luminaire configured as described herein may be adjusted electronically without need for mechanical movements, contrary to existing lighting systems. Also, as discussed below, control of the emission of the disclosed luminaire may be provided using any of a wide range of wired and/or wireless control interfaces, such as a switch array, a touch-sensitive surface or device, and/or a computer vision system (e.g., that is gesture-sensitive, activity-sensitive, and/or motion-sensitive, for example), to name a few.

In accordance with some embodiments, the disclosed luminaire can be configured as a recessed light, a pendant light, a sconce, or the like which may be mounted, for example, on a ceiling, wall, floor, step, or other suitable surface, as will be apparent in light of this disclosure. In some other embodiments, the disclosed luminaire can be configured as a free-standing lighting device, such as a desk lamp or torchiére lamp. In some other embodiments, a luminaire configured as described herein may be mounted, for example, on a drop ceiling tile (e.g., 2 ft.×2 ft., 2 ft.×4 ft., 4 ft.×4 ft., or larger) for installment in a drop ceiling grid. Numerous other suitable configurations will be apparent in light of this disclosure.

As will be appreciated in light of this disclosure, a luminaire configured as described herein may provide for flexible and easily adaptable lighting, capable of accommodating any of a wide range of lighting applications and contexts, in accordance with some embodiments. For example, some embodiments may provide for downlighting adaptable to small and large area tasks (e.g., high intensity with adjustable distribution and directional beams). Some embodiments may provide for accent lighting or area lighting of any of a wide variety of distributions (e.g., narrow, wide, asymmetric/tilted, Gaussian, batwing, or other specifically shaped beam distribution). By turning on/off and/or dimming the intensity of various combinations of solid-state emitter devices of the luminaire, the light beam output may be adjusted, for instance, to produce uniform illumination on a given surface, to fill a given space with light, or to generate any desired area lighting distributions. In some cases, the luminaire can be used to create spot area shapes, such as a circle or ellipse, a square or rectangle (e.g., which can be used to fill corner areas), a star, an arrow, or other fanciful or customized shape, as desired. Some embodiments may provide for emergency lighting or other direction-finding lighting. That is, the disclosed luminaire may be configured to provide a moving spotlight along a path of egress so that bystanders may be directed to a safe location. This can be done, for example, by sequentially activating solid-state lamps that lie on a plane intersecting the housing while allowing the remaining solid-state lamps of the luminaire to emit at a lower level to provide other desired emergency illuminance. Numerous other suitable uses and applications will be apparent in light of this disclosure.

As will be further appreciated in light of this disclosure, a luminaire configured as described herein may be considered, in a general sense, a robust, intelligent, multi-purpose lighting platform capable of producing a highly adjustable light output without requiring mechanical movement of luminaire componentry. Some embodiments may provide for a greater level of light beam adjustability, for example, as compared to traditional lighting designs utilizing larger moving mechanical parts. Some embodiments may realize a reduction in cost, for example, as a result of the use of longer-lifespan solid-state devices and reduced installation, operation, and other labor costs. Furthermore, the scalability and orientation of a luminaire configured as described herein may be varied, in accordance with some embodiments, to adapt to a specific lighting context or application (e.g., downward-facing, such as a drop ceiling lighting fixture, pendant lighting fixture, a desk light, etc.; upward-facing, such as indirect lighting aimed at a ceiling).

System Architecture and Operation

Figure 1B:
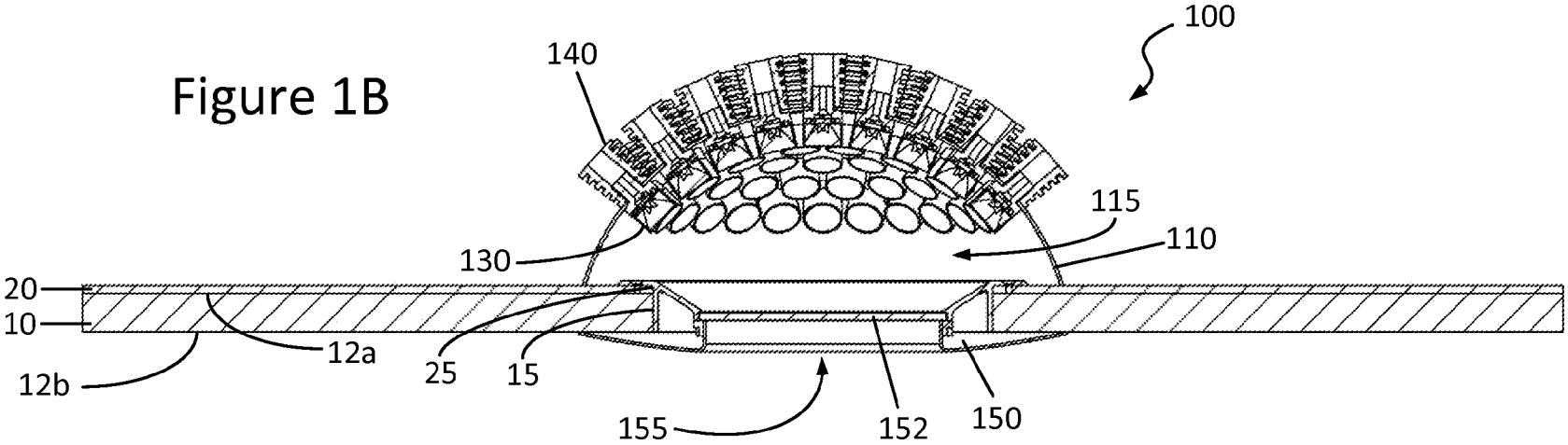
FIG. 1B is a cross-sectional view of the luminaire of FIG. 1A taken along line X-X.
Figure 2A:
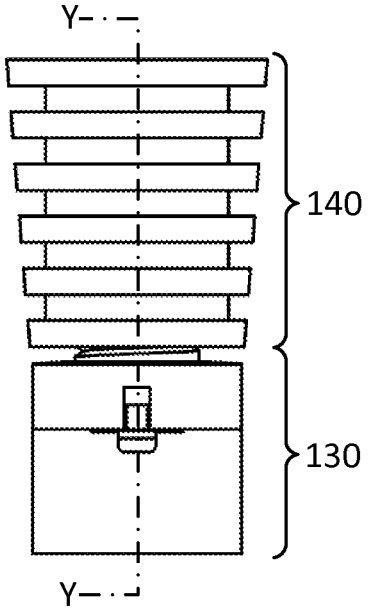
FIG. 2A is a side view of a solid-state lamp and heat sink assembly configured in accordance with an embodiment of the present disclosure.
Figure 2B:
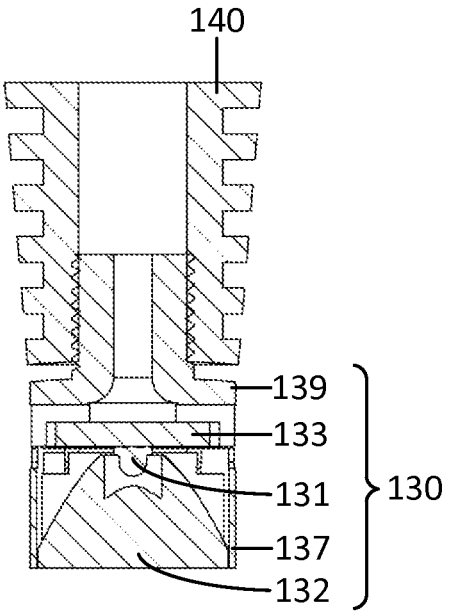
FIG. 2B is a cross-sectional view of the solid-state lamp and heat sink assembly of FIG. 2A taken along line Y-Y.
Figure 2C:
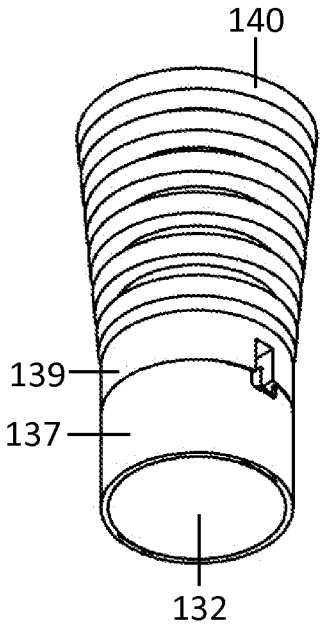
FIGS. 2C and 2D are perspective views of a solid-state lamp and heat sink assembly configured in accordance with an embodiment of the present disclosure.
Figure 2D:
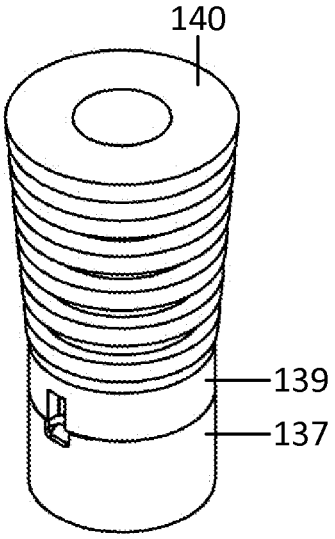

FIGS. 1A and 1B illustrate a luminaire 100 configured in accordance with an embodiment of the present disclosure. As can be seen, luminaire 100 includes a housing 110, a plurality of solid-state lamps 130 arranged within the plenum 115 of housing 110, and one or more optional heat sinks 140 coupled with those lamps 130 and arranged on the exterior of housing 110. A discussion of these is provided below. Also, as discussed below, luminaire 100 may be configured to be mounted on or otherwise fixed to a mounting surface 10 in a temporary or permanent manner, and in some such cases, a support plate 20 optionally may be included, in accordance with some embodiments.

As previously noted, luminaire 100 includes a housing 110 having a hollow space therein which defines a plenum 115. In accordance with some embodiments, housing 110 may serve, at least in part: (1) to protect or otherwise house the plurality of solid-state lamps 130 of luminaire 100 within plenum 115 (e.g., in some cases in which the solid-state lamps 130 are arranged on one or more interior surfaces of housing 110); and/or (2) to help conduct thermal energy away from the plurality of solid-state lamps 130 of luminaire 100 to the ambient environment. To these ends, housing 110 may be constructed from any of a wide variety of materials, such as: aluminum (Al); copper (Cu); brass; steel; composites and/or polymers (e.g., ceramics, plastics, etc.) doped with thermally conductive material; and/or a combination thereof. Other suitable materials from which housing 110 may be constructed will depend on a given application and will be apparent in light of this disclosure.

The geometry of housing 110 may be customized as desired for a given target application or end-use. In some embodiments, housing 110 may be configured with a non-planar/curved geometry. In some example cases, housing 110 may exhibit a hemispherical geometry (e.g., like that shown in FIG. 1B). In some other example cases, housing 110 may exhibit a sectional hemispherical geometry. In some other example cases, housing 110 may exhibit an oblate hemispherical geometry. In some instances, this type of geometry may help to provide housing 110 with additional space for hosting solid-state lamps 130 if the depth of housing 110 is otherwise limited (e.g., in cases in which expansion of the depth of plenum 115 is not possible or otherwise not practical). Other example suitable curved geometries for housing 110 include: concave; convex; elliptical; parabolic; hyperbolic; complex parabolic; and the like. In some other embodiments, housing 110 may be configured with a Platonic solid-type geometry (e.g., having planar faces/sides), such as a triangular geometry, a rectangular geometry, or a trapezoidal geometry, among others. In some still other embodiments, housing 110 may be configured as a cylinder, pyramid, truncated pyramid, or other hollow, geometrical cavity. Numerous suitable configurations will be apparent in light of this disclosure.

The dimensions of housing 110 can be customized as desired for a given target application or end-use. For example, in some embodiments, housing 110 may have a width/diameter in the range of about 2-10 inches (e.g., about 2-4 inches, about 4-6 inches, about 6-8 inches, about 8-10 inches, or any other sub-range within the range of about 2-10 inches). In some example cases, housing 110 may have a diameter of about 8 inches±2 inches. In some other embodiments, housing 110 may have a width/diameter greater than about 10 inches (e.g., in the range of about 10-20 inches, about 20-30 inches, about 30-40 inches, about 40-50 inches, or greater). In a more general sense, the dimensions of housing 110 may be varied, for example, to be commensurate with the particular mounting surface 10 on which it is to be mounted or other space which it is to occupy (e.g., mounted on a drop ceiling tile; suspended from a ceiling or other overhead structure; extending from a wall, floor, or step; configured as a free-standing or otherwise portable lighting device). Other suitable sizes for housing 110 will depend on a given application and will be apparent in light of this disclosure.

As previously noted, luminaire 100 can include a plurality of solid-state lamps 130 arranged within plenum 115 along one or more interior surfaces of housing 110 and (optionally) one or more associated heat sinks 140 arranged on the one or more exterior surfaces of housing 110. FIGS. 2A-2D illustrate several views of a solid-state lamp 130 and heat sink 140 assembly, configured in accordance with an embodiment of the present disclosure. As can be seen, and as discussed below, a given solid-state lamp 130 can include one or more solid-state emitters 131 populated on a printed circuit board (PCB) 133 (or other suitable intermediate/substrate) and optically coupled with an optics assembly 132. In some instances, the optics 132 and solid-state emitter(s) 131 may be disposed within or otherwise protected by a head 137 of solid-state lamp 130. Also, a given solid-state lamp 130 may include a base portion 139, discussed below. The quantity/density of solid-state lamps 130 utilized in luminaire 100 may be customized, as desired for a given target application or end-use. In some cases, a corresponding quantity/density of heat sinks 140 may be utilized as well. Numerous suitable configurations will be apparent in light of this disclosure.

A given solid-state emitter 131 may be any of a wide variety of semiconductor light source devices. Some suitable solid-state emitters 131 include, for example: a light-emitting diode (LED) (e.g., high-brightness, bi-color, tri-color, etc.); an organic light-emitting diode (OLED); a polymer light-emitting diode (PLED); and/or any combination thereof. Also, a given solid-state emitter 131 may be configured to emit wavelength(s) from any spectral band (e.g., visible spectral band, infrared spectral band, ultraviolet spectral band, etc.), as desired for a given target application or end-use. Some embodiments may include one or more white light-emitting solid-state emitters 131, while some other embodiments may include one or more multiple-color solid-state emitters 131 (e.g., bi-color LEDs, tri-color LEDs, etc.). Furthermore, a given solid-state emitter 131 can be packaged or non-packaged, as desired, and in some cases may be populated on a printed circuit board (PCB) 133 or other suitable intermediate/substrate, as will be apparent in light of this disclosure. Other suitable solid-state emitter 131 configurations will depend on a given application and will be apparent in light of this disclosure.

The PCB 133 and one or more solid-state emitters 131 of a given solid-state lamp 130 may be held or otherwise hosted by a base portion 139. The base portion 139 of a given solid-state lamp 130 may be configured to interface with housing 110 in a variety of ways. For instance, in some cases, the base portion 139 of a solid-state lamp 130 may be configured to be received and retained by a recess or aperture formed in housing 110. To that end, base portion 139 may be threaded such that it may be screwed into a correspondingly threaded recess/aperture formed in the wall of housing 110. In some other cases, base portion 139 may be configured to be affixed to housing 110 using an epoxy, tape, or other suitable adhesive, as will be apparent in light of this disclosure. Also, the base portion 139 of a given solid-state lamp 130 may be configured to interface with a heat sink 140, discussed below.

Coupling of a base portion 139 with housing 110 may help to provide a thermal pathway between the PCB 133 and the one or more solid-state emitters 131 populated thereon and housing 110. This may help to conduct away thermal energy produced by the solid-state emitter(s) 131, dissipating the heat to the ambient environment. To that end, a given base portion 139 may be constructed from any of a wide variety of thermally conductive materials. For instance, in some cases, a given base portion 139 may be constructed from a metal, such as: aluminum (Al); copper (Cu); silver (Ag); gold (Au); brass; steel; and/or an alloy of any thereof. In some other cases, a given base portion 139 may be constructed from a composite (e.g., a ceramic) or a polymer (e.g., a plastic) of sufficient thermal conductivity. Other suitable materials from which a given base portion 139 may be constructed will depend on a given application and will be apparent in light of this disclosure.

As can further be seen from the figures, a given solid-state lamp 130 also includes optics 132 coupled with its one or more solid-state emitters 131. The optics 132 may be configured to transmit the wavelength(s) of interest (e.g., visible, ultraviolet, infrared, etc.) of the light emitted, for example, by the associated solid-state emitter(s) 131. In some cases, the optics 132 of a given solid-state lamp 130 may include an optical structure comprising any of a wide variety of transparent/translucent materials, such as, for example: a polymer, such as poly(methyl methacrylate) (PMMA) or polycarbonate; a ceramic, such as sapphire ($Al_2O_3$) or yttrium aluminum garnet (YAG); a glass; and/or any combination thereof. In some cases, the optics 132 of a given solid-state lamp 130 may include electronically controllable componentry which may be used to modify the output of the host solid-state lamp 130. For example, a given optics assembly 132 may include one or more electro-optic tunable lenses which can be electronically adjusted to vary the angle, direction, and/or size (among other attributes) of the light beam output by a given solid-state lamp 130. In some cases, the optics 132 of a given solid-state lamp 130 may include optical components, such as, for example: a reflector; a diffuser; a polarizer; a brightness enhancer; and/or a phosphor material (e.g., which converts light received thereby to light of a different wavelength). As previously explained, the optics assembly 132 of a given solid-state lamp 130 may be encased by or otherwise disposed within a head 137 extending from base portion 139. Other suitable types and configurations for the optics 132 of a given solid-state lamp 130 may depend on the given application and will be apparent in light of this disclosure.

Also, as can be seen from the figures, luminaire 100 may include one or more heat sinks 140 arranged on the exterior surface of housing 110. As previously noted, the base portion 139 of a given solid-state lamp 130 may be configured to interface with a heat sink 140. For instance, in some cases, the base portion 139 of a solid-state lamp 130 may be configured to extend through an aperture formed in the wall of housing 110 and be received and retained by a recess or aperture formed in a heat sink 140. To that end, base portion 139 may be threaded such that it may be screwed into a correspondingly threaded recess/aperture formed in the body of a heat sink 140. In some other cases, heat sinks 140 may be pre-formed into or otherwise as part of housing 110 (e.g., heat sinks 140 and housing 110 may be integrated with one another). In some still other cases, luminaire 100 may be provided without any heat sinks 140. Numerous suitable configurations will be apparent in light of this disclosure.

Coupling of a base portion 139 with a heat sink 140 may help to provide a thermal pathway between the PCB 133 and the one or more solid-state emitters 131 populated thereon and that heat sink 140. This may help to conduct away thermal energy produced by the solid-state emitter(s) 131, dissipating the heat to the ambient environment. To that end, a given heat sink 140 may be constructed from any of a wide variety of thermally conductive materials. For instance, in some cases, a given heat sink 140 may be constructed from a metal, such as: aluminum (Al); copper (Cu); silver (Ag); gold (Au); brass; steel; and/or an alloy of any thereof. In some other cases, a given heat sink 140 may be constructed from a composite (e.g., a ceramic) or a polymer (e.g., a plastic) of sufficient thermal conductivity. Other suitable materials from which a given heat sink 140 may be constructed will depend on a given application and will be apparent in light of this disclosure.

As previously noted, luminaire 100 may be configured, in some embodiments, to be mounted or otherwise fixed to a mounting surface 10 in a temporary or permanent manner. In some cases, luminaire 100 may be configured to be mounted as a recessed lighting fixture, while in some other cases, luminaire 100 may be configured as a pendant-type fixture, a sconce-type fixture, or other lighting fixture which may be suspended or otherwise extended from a given mounting surface 10. Some example suitable mounting surfaces 10 include ceilings, walls, floors, and/or steps. In some instances, mounting surface 10 may be a drop ceiling tile (e.g., having an area of about 2 ft.×2 ft., 2 ft.×4 ft., 4 ft.×4 ft., etc.) for installment in a drop ceiling grid. However, it should be noted that luminaire 100 need not be configured to be mounted on a mounting surface 10 and instead may be configured, in some instances, as a free-standing or otherwise portable lighting device, such as a desk lamp or a torchiére lamp, for example. Other suitable configurations will depend on a given application and will be apparent in light of this disclosure.

Figure 3A:
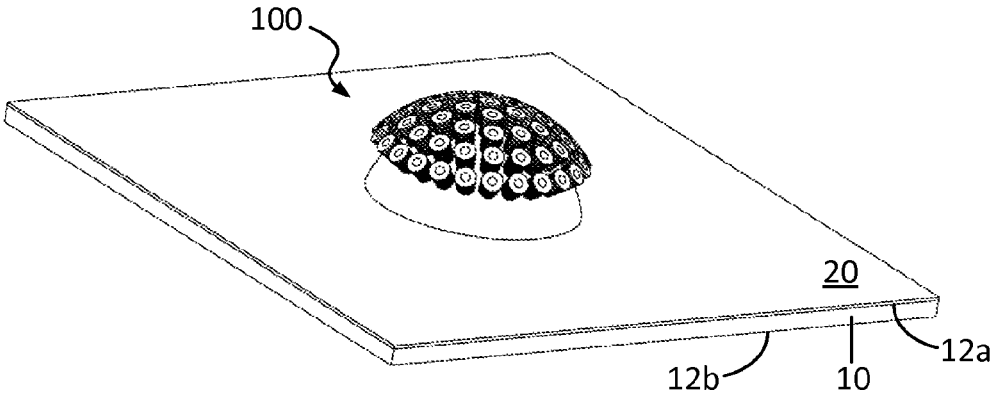
FIGS. 3A-3B are perspective views of a luminaire mounted on a mounting surface in accordance with an embodiment of the present disclosure.
Figure 3B:
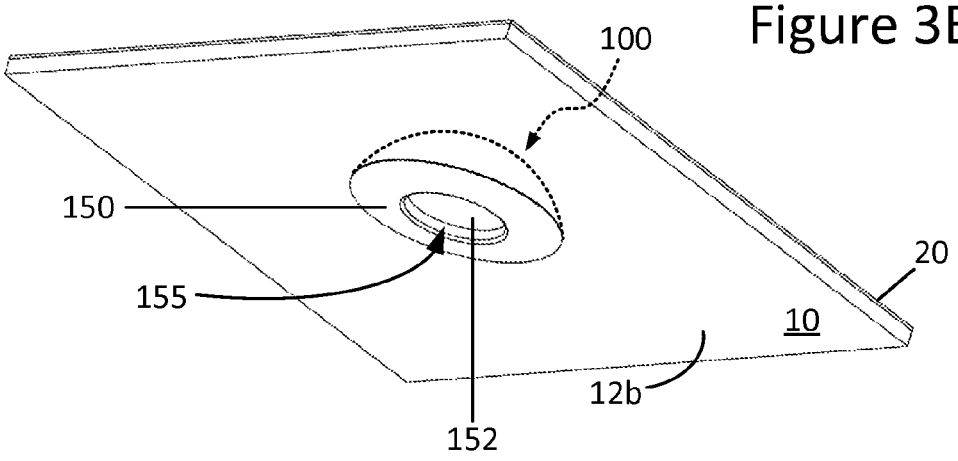

FIGS. 3A and 3B illustrate a luminaire 100 mounted on a mounting surface 10, in accordance with an embodiment of the present disclosure. As can be seen, the housing 110 of luminaire 100 may be positioned adjacent a first side 12*a* (e.g., a back side) of mounting surface 10. In some cases, the housing 110 of luminaire 100 may be in direct physical contact with mounting surface 10, while in some other cases, an intermediate (e.g., such as an optional support plate 20, discussed below) may be disposed between the housing 110 and mounting surface 10.

As can further be seen, mounting surface 10 may have an aperture 15 formed therein which passes through the thickness of mounting surface 10 from its first side 12*a* to its second side 12*b*. In some instances, mounting surface 10 optionally may have multiple such apertures 15 formed therein. This may be desirable, for example, in cases in which housing 110 is provided with an elongated geometry (e.g., such as an oblate hemispherical geometry) or in which housing 110 covers a sufficiently large portion of a given mounting surface 10 (e.g., such as if luminaire 100 is dimensioned to substantially cover the area of a drop ceiling tile). Other situations in which multiple apertures 15 may be utilized will be apparent in light of this disclosure. In accordance with some embodiments, luminaire 100 may be positioned/aligned relative to the aperture(s) 15 in the mounting surface 10 such that the light emitted by any one or more of the solid-state lamps 130 emerges from luminaire 100 with minimal or otherwise negligible overlap with the perimeter of a given aperture 15, thus helping to ensure that substantially all of the light emitted by lamps 130 exits luminaire 100.

The geometry and size of a given aperture 15 of mounting surface 10 may be customized, as desired for a given target application or end-use. For example, in some instances, a given aperture 15 may be provided with a geometry which substantially corresponds with that of housing 110 (e.g., if housing 110 is substantially hemispherical, then an associated aperture 15 may be substantially circular); if housing 110 is substantially oblate hemispherical, then an associated aperture 15 may be substantially elliptical; etc.). In some cases, a given aperture 15 may have a width/diameter in the range of about 1-7 inches (e.g., about 1-3 inches, about 3-5 inches, about 5-7 inches, or any other sub-range in the range of about 1-7 inches). In some example cases, aperture 15 may have a diameter of about 4 inches±1 inch. In some other cases, a given aperture 15 may have a width/diameter greater than about 7 inches (e.g., in the range of about 7-10 inches, about 10-13 inches, about 13-16 inches, about 16-19 inches, or greater). In a more general sense, the geometry and dimensions of a given aperture 15 may be varied, for example, to be commensurate with the geometry and dimensions of housing 110 and the particular arrangement of solid-state lamps 130 within plenum 115 of luminaire 100. In some cases, aperture 15 may be smaller in size than the distribution area of the solid-state lamps 130 within housing 110. Thus, in some instances, aperture 15 may be smaller in size than the light field of luminaire 100 (e.g., smaller than the physical distribution area of the solid-state emitters 131 within housing 110). Also, in some embodiments, aperture 15 may be configured such that one or more of the light beams produced by the solid-state lamps 130 of luminaire 100 pass through a focal point generally located within aperture 15. Other suitable geometries and dimensions for a given aperture 15 formed in mounting surface 10 will depend on a given application and will be apparent in light of this disclosure.

In some cases, a bezel 150 optionally may be utilized with luminaire 100. When included, bezel 150 may be positioned adjacent a second side 12*b* of mounting surface 10 and may be configured to reside within and/or about a given aperture 15. In cases in which a bezel 150 is utilized, one or more apertures 155 may be formed therein, for instance, corresponding in quantity, geometry, and/or dimensions with the aperture(s) 15 formed in mounting surface 10. Also, as will be appreciated in light of this disclosure, bezel 150 alternatively can be referred to, for example, as a trim, collar, or baffle in other embodiments. In some cases, aperture 155 may be smaller in size than the distribution area of solid-state lamps 130 within housing 110. Thus, in some instances, aperture 155 may be smaller in size than the light field of luminaire 100 (e.g., smaller than the physical distribution area of the solid-state emitters 131 within housing 110). In some cases, aperture 15 (e.g., formed within mounting surface 10) may be provided with a geometry and/or size like that of aperture 155 (e.g., of optional bezel 150). Also, in some embodiments, aperture 155 may be configured such that one or more of the light beams produced by the solid-state lamps 130 of luminaire 100 pass through a focal point generally located within aperture 155. Other suitable configurations, geometries, and dimensions for optional bezel 150 and its one or more apertures 155 will depend on a given application and will be apparent in light of this disclosure.

In some instances, an optics assembly 152 may be provided with the mounting surface 10. The optics 152 may be configured to transmit the wavelength(s) of interest (e.g., visible, ultraviolet, infrared, etc.) of the light emitted, for example, by the solid-state lamps 130 of luminaire 100. In some cases, the optics 152 may include an optical structure (e.g., a window) comprising any of a wide variety of transparent/translucent materials, such as, for example: a polymer, such as poly(methyl methacrylate) (PMMA) or polycarbonate; a ceramic, such as sapphire ($Al_2O_3$) or yttrium aluminum garnet (YAG); a glass; and/or any combination thereof. In some instances, the optics 152 may include optical features, such as, for example: an anti-reflective (AR) coating; a diffuser; a polarizer; a brightness enhancer; and/or a phosphor material (e.g., which converts light received thereby to light of a different wavelength). In some cases, the optics 152 may include electronically controllable componentry which may be used to modify the output of the solid-state lamps 130 of luminaire 100. For example, the optics assembly 152 may include an electro-optic tunable lens or other suitable focusing optics which can be electronically adjusted to narrow or widen accumulated light distribution, thereby contributing to varying the beam angle, beam direction, beam distribution, and/or beam size (among other attributes) of the light beam output by luminaire 100. In some other cases, optics assembly 152 may include a Fresnel lens or other fixed optics (e.g., disposed with aperture 155), for example, to modify the beam distributions. In some instances, the optics assembly 152 may be encased by or otherwise disposed within an optionally included bezel 150 (discussed above).

In some cases, a support plate 20 optionally may be utilized with luminaire 100, for example, to provide additional structural support and/or thermal energy dissipation for a luminaire 100. When included, support plate 20 may be positioned adjacent a first side 12*a* of mounting surface 10. Housing 110 and support plate 20 may be separate components which are interfaced with one another (e.g., housing 110 is situated on support plate 20), or they may be integrated together as a single piece (e.g., support plate 20 and housing 110 are constructed from a continuous piece of material), as desired for a given target application or end-use. In cases in which a support plate 20 is utilized, one or more apertures 25 may be formed therein, for instance, corresponding in quantity, geometry, and/or dimensions with the aperture(s) 15 formed in mounting surface 10. This may allow the light emitted by any one or more of the solid-state lamps 130 to emerge from luminaire 100 with minimal or otherwise negligible overlap with the perimeter of a given aperture 25, thus helping to ensure that substantially all of the light emitted by lamps 130 exits luminaire 100.

Coupling of support plate 20 with housing 110 (e.g., either by interfacing thereof with housing 110 or integration thereof with housing 110) may help to provide a thermal pathway between the PCB 133 and one or more solid-state emitters 131 of a given solid-state lamp 130 and the support plate 20. This may help to conduct away thermal energy produced by the solid-state emitter(s) 131, dissipating the heat to the ambient environment. To that end, the support plate 20 may be constructed from any of a wide variety of thermally conductive materials. For instance, in some cases, support plate 20 may be constructed from a metal, such as: aluminum (Al); copper (Cu); silver (Ag); gold (Au); brass; steel; and/or an alloy of any thereof. In some other cases, support plate 20 may be constructed from a composite (e.g., a ceramic) or a polymer (e.g., a plastic) of sufficient thermal conductivity. Other suitable materials from which support plate 20 may be constructed will depend on a given application and will be apparent in light of this disclosure.

Figure 4A:
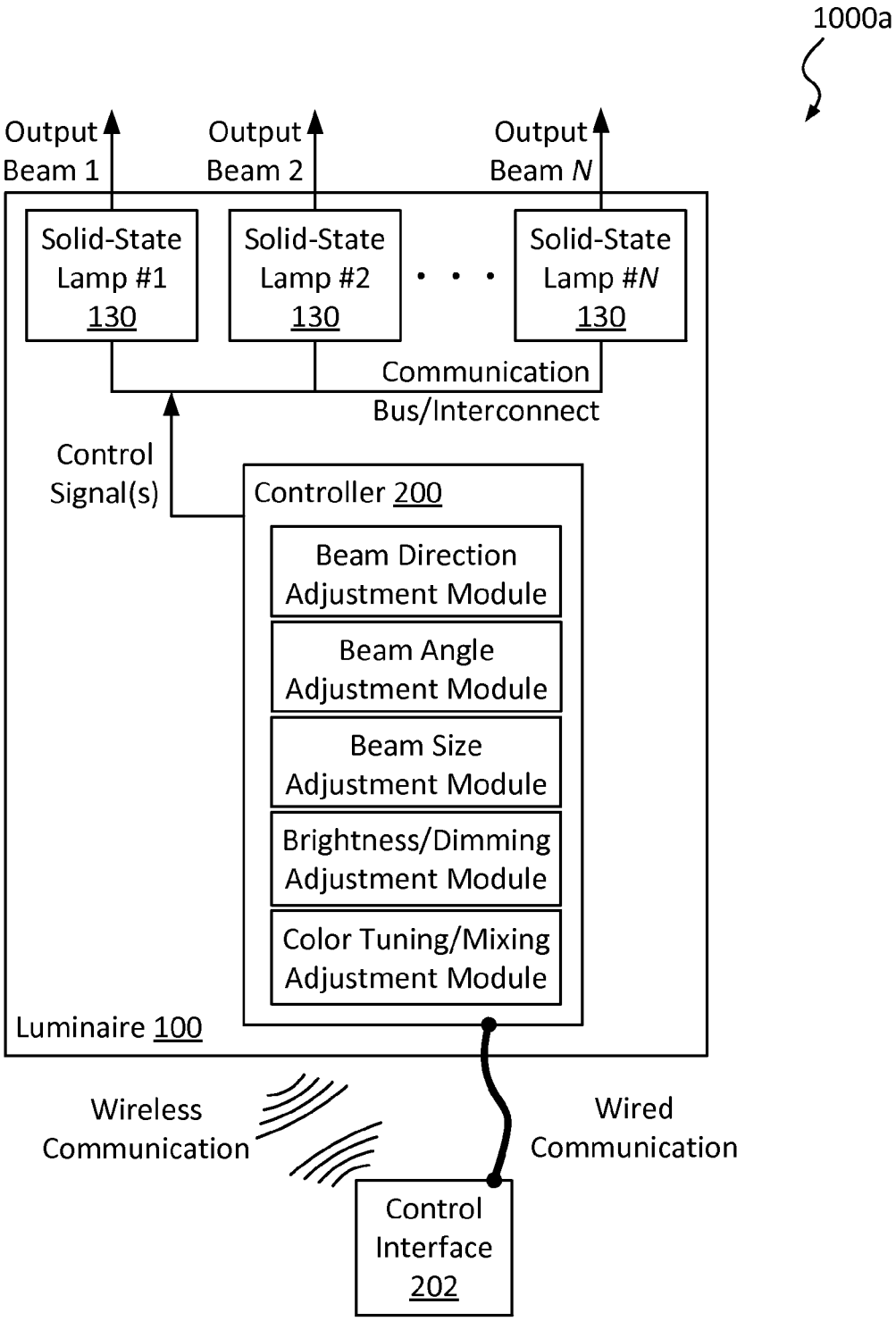
FIG. 4A is a block diagram of a lighting system configured in accordance with an embodiment of the present disclosure.

As previously noted, the solid-state lamps 130 of luminaire 100 can be electronically controlled individually and/or in conjunction with one another, for example, to provide highly adjustable light emissions from the luminaire 100. To that end, luminaire 100 may include or otherwise be communicatively coupled with one or more controllers 200. For example, consider FIG. 4A, which is a block diagram of a lighting system 1000*a* configured in accordance with an embodiment of the present disclosure. Here, a controller 200 is operatively coupled (e.g., by a communication bus/interconnect) with the solid-state lamps 130 1-N of luminaire 100. In this example case, controller 200 may output a control signal to any one or more of the solid-state lamps 130 and may do so, for example, based on wired and/or wireless input received from one or more control interfaces 202, discussed below. As a result, luminaire 100 may be controlled in such a manner as to output any number of output beams 1-N, which may be varied in beam direction, beam angle, beam size, beam distribution, brightness/dimness, and/or color, as desired for a given target application or end-use.

Figure 4B:
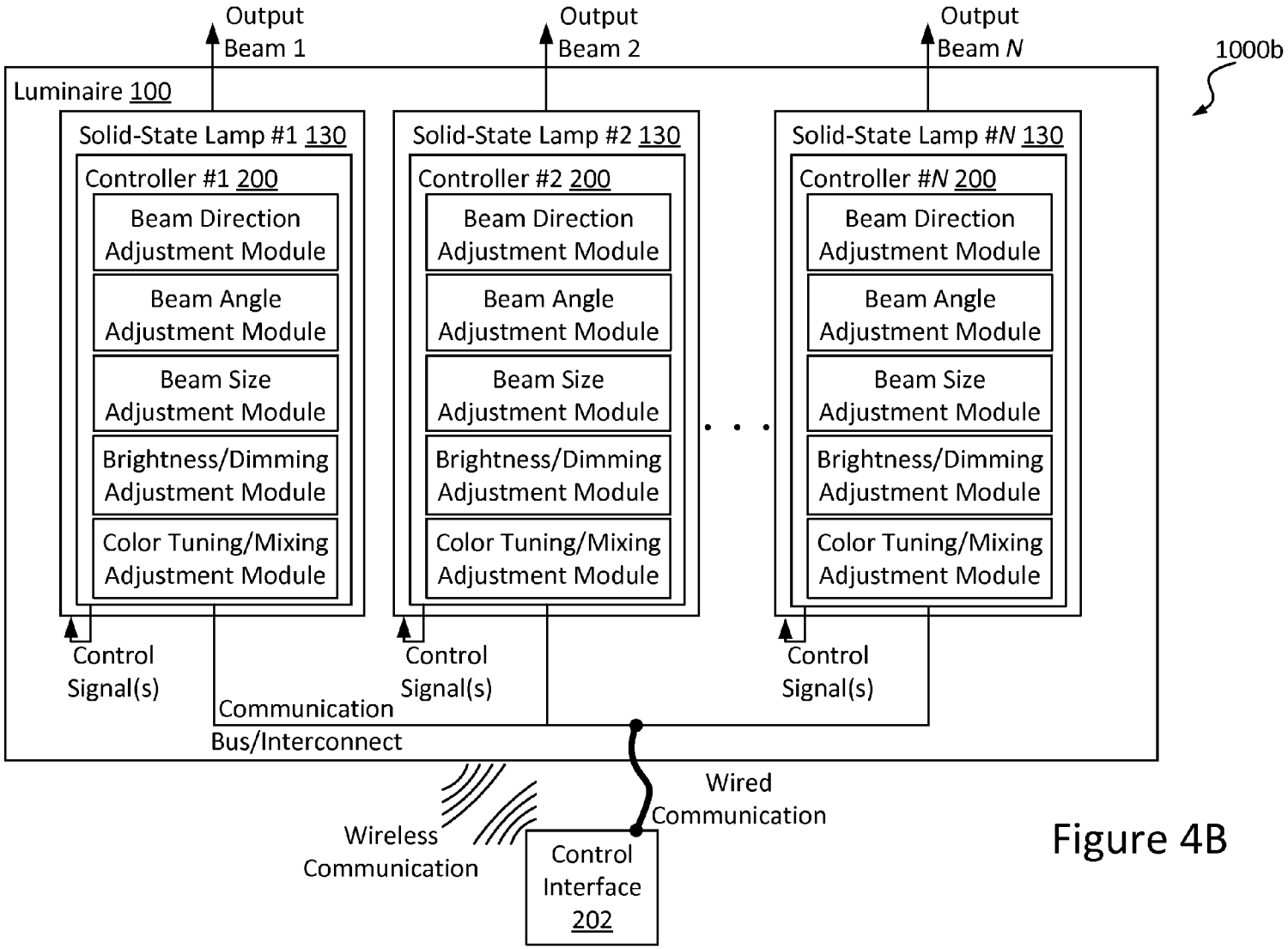
FIG. 4B is a block diagram of a lighting system configured in accordance with another embodiment of the present disclosure.

However, the present disclosure is not so limited. For instance, consider FIG. 4B, which is a block diagram of a lighting system 1000*b* configured in accordance with another embodiment of the present disclosure. Here, each solid-state lamp 130 1-N of luminaire 100 includes its own controller 200. In a sense, each solid-state lamp 130 may be considered as effectively having its own mini-controller, thus providing luminaire 100 with a distributed controller 200. In some instances, the controller 200 of a given solid-state lamp 130 may be populated, for example, on PCB 133. In this example case, a given controller 200 may output a control signal to an associated solid-state lamp 130 of luminaire 100 and may do so, for example, based on wired and/or wireless input received from one or more control interfaces 202, discussed below. As a result, luminaire 100 may be controlled in such a manner as to output any number of output beams 1-N, which may be varied in beam direction, beam angle, beam size, beam distribution, brightness/dimness, and/or color, as desired for a given target application or end-use.

In accordance with some embodiments, a given controller 200 may host one or more lighting control modules and can be programmed or otherwise configured to output one or more control signals, for example, to adjust the operation of: (1) the one or more solid-state emitters 131 of a given solid-state lamp 130; (2) the optics 132 of a given solid-state lamp 131; and/or (3) an optics assembly 152 hosted by the mounting surface 10 (e.g., in an aperture 15 and/or optional bezel 150). For example, in some cases, a given controller 200 may be configured to output a control signal to control whether the beam is on/off, as well as control the beam direction, beam angle, beam distribution, and/or beam diameter of the light emitted by a given solid-state lamp 130. In some instances, a given controller 200 may be configured to output a control signal to control the intensity/brightness (e.g., dimming, brightening) of the light emitted by a given solid-state emitter 131. In some cases, a given controller 200 may be configured to output a control signal to control the color (e.g., mixing, tuning) of the light emitted by a given solid-state emitter 131. Thus, if a given solid-state lamp 130 includes two or more solid-state emitters 131 configured to emit light having different wavelengths, the control signal may be used to adjust the relative brightness of the different solid-state emitters 131 in order to change the mixed color output by that solid-state lamp 130. In some cases, a given controller 200 may utilize a digital communications protocol, such as a digital multiplexer (DMX) interface, a Wi-Fi™ protocol, a digital addressable lighting interface (DALI) protocol, a ZigBee protocol, or any other suitable communications protocol, wired and/or wireless, as will be apparent in light of this disclosure. In some still other cases, a given controller 200 may be configured as a terminal block or other pass-through such that a given control interface 202 is effectively coupled directly with the individual solid-state emitters 131 of luminaire 100. Numerous suitable configurations will be apparent in light of this disclosure.

Also, as previously noted, control of the solid-state lamps 130 of luminaire 100 may be provided using any of a wide range of wired and/or wireless control interfaces 202. For example, in some embodiments, one or more switches (e.g., an array of switches) may be utilized to control the solid-state emitters 131 of luminaire 100 individually and/or in conjunction with one another. A given switch may be, for instance, a sliding switch, a rotary switch, a toggle switch, a push-button switch, or any other suitable switch, as will be apparent in light of this disclosure. In some instances, one or more switches may be operatively coupled with a given controller 200, which in turn interprets the input and distributes the desired control signal(s) to one or more of the solid-state emitters 131 of the solid-state lamps 130 of luminaire 100. In some other instances, one or more switches may be operatively coupled directly with solid-state emitters 131 to control them directly.

In some embodiments, a touch-sensitive device or surface, such as a touchpad or other device with a touch-based user interface, may be utilized to control the solid-state emitters 131 of the solid-state lamps 130 of luminaire 100 individually and/or in conjunction with one another. In some instances, the touch-sensitive interface may be operatively coupled with one or more controllers 200, which in turn interpret the input from the control interface 202 and provide the desired control signal(s) to one or more of the solid-state emitters 131 of luminaire 100. In some other instances, the touch-sensitive interface may be operatively coupled directly with the solid-state emitters 131 to control them directly.

In some embodiments, a computer vision system that is, for example, gesture-sensitive, activity-sensitive, and/or motion-sensitive may be utilized to control the solid-state emitters 131 of the solid-state lamps 130 of luminaire 100 individually and/or in conjunction with one another. In some such cases, this may provide for a luminaire 100 which can automatically adapt its light emissions based on a particular gesture-based command, sensed activity, or other stimulus. In some instances, the computer vision system may be operatively coupled with one or more controllers 200, which in turn interpret the input from the control interface 202 and provide the desired control signal(s) to one or more of the solid-state emitters 131 of luminaire 100. In some other instances, the computer vision system may be operatively coupled directly with the solid-state emitters 131 to control them directly. Other suitable configurations and capabilities for a given controller 200 and the one or more control interfaces 202 will depend on a given application and will be apparent in light of this disclosure.

As will be appreciated in light of this disclosure, luminaire 100 also may be operatively coupled with other componentry, for example, which may be used in solid-state lighting fixtures, such as power conversion circuitry (e.g., electrical ballast circuitry to convert an AC signal into a DC signal at a desired current and voltage to power the solid-state devices), driver circuitry, and the like. Also, it should be noted that a luminaire 100 configured as described herein is not necessarily prevented, for example, from utilizing electromechanical components which have physical movement. For instance, in some cases, luminaire 100 may be configured to host a microelectromechanical systems (MEMS) mirror array which provides reflective surfaces with adjustable foci. The solid-state lamps 130 (discussed above) and these mirror arrays may be distributed within the plenum 115 of housing 110 (e.g., on the interior surface thereof), and one or more of the solid-state lamps 130 may be made to illuminate a given mirror array, which in turn focuses the light in the desired direction out of luminaire 100. Other suitable optional electromechanical components for luminaire 100 will depend on a given application and will be apparent in light of this disclosure.

Figure 5:
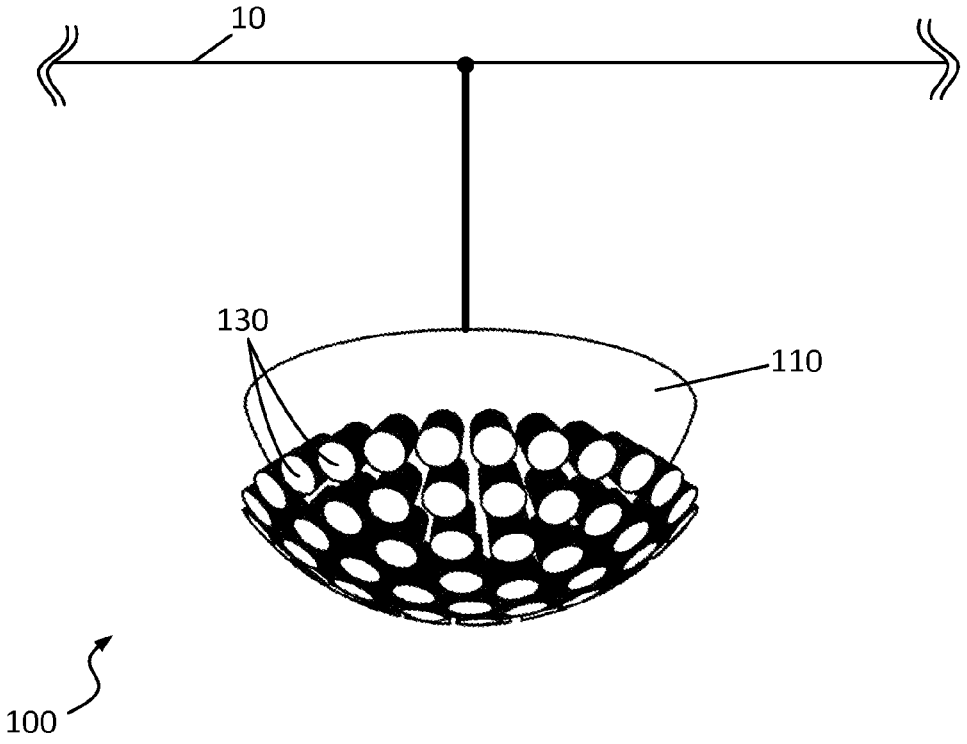
FIG. 5 is a side view of a luminaire configured in accordance with another embodiment of the present disclosure.

Also, as previously noted, luminaire 100 may be configured as a lighting fixture which may be suspended or otherwise extended from a given mounting surface 10, such as a pendant-type fixture, a sconce-type fixture, etc. For example, consider FIG. 5, which illustrates a luminaire 100 configured in accordance with another embodiment of the present disclosure. As can be seen in this example case, housing 110 may exhibit a hemispherical geometry, providing an exterior surface which exhibits a convex curvature, and the plurality of solid-state lamps 130 may be arranged on the exterior surface of such housing 110, in accordance with some embodiments. As will be appreciated in light of this disclosure, however, housing 110 is not limited only to the example hemispherical geometry depicted, as in other embodiments, housing 110 may be configured with any of the various types of geometries (e.g., non-planar/curved, such as sectional hemispherical, oblate hemispherical, concave, convex, cylindrical, elliptical, parabolic, hyperbolic, complex parabolic; Platonic solid-type, such as triangular, rectangular, trapezoidal, pyramidal, truncated pyramidal) discussed above with reference to FIGS. 1A-1B. Numerous suitable configurations will be apparent in light of this disclosure.

In some embodiments, luminaire 100 may be configured, for example, such that no two of its solid-state emitters 131 are pointed at the same spot on a given surface of incidence. Thus, there may be a one-to-one mapping of the solid-state lamps 130 of luminaire 100 to the beam spots which it produces on a given surface of incidence. This one-to-one mapping may provide for pixelated control over the light distribution of luminaire 100, in accordance with some embodiments. That is, luminaire 100 may be capable of outputting a polar, grid-like pattern of light beam spots which can be manipulated (e.g., in intensity, etc.), for instance, like the regular, rectangular grid of pixels of a display. Like the pixels of a display, the beam spots produced by luminaire 100 can have minimal or otherwise negligible overlap, in accordance with some embodiments. This may allow the light distribution of luminaire 100 to be manipulated in a manner similar to the way that the pixels of a display can be manipulated to create different patterns, spot shapes, and distributions of light, in accordance with some embodiments. Furthermore, luminaire 100 may exhibit minimal or otherwise negligible overlap of the angular distributions of light of its solid-state emitters 131, and thus the candela distribution can be adjusted (e.g., in intensity, etc.) as desired for a given target application or end-use. As will be appreciated in light of this disclosure, however, luminaire 100 also may be configured to provide for pointing two or more solid-state emitters 131 at the same spot (e.g., such as when color mixing using multiple color solid-state emitters 131 is desired), in accordance with some embodiments. In a more general sense, and in accordance with some embodiments, the solid-state lamps 130 may be mounted on a given interior or exterior surface of housing 110 such that their orientation provides a given desired beam distribution from luminaire 100.

Numerous embodiments will be apparent in light of this disclosure. One example embodiment provides a luminaire including: a housing; a plurality of solid-state lamps arranged on the housing, wherein light emitted by the plurality of solid-state lamps exhibits a one-to-one mapping of the solid-state lamps to beam spots produced thereby; and a controller communicatively coupled with at least one of the plurality of solid-state lamps and configured to provide pixelated control over light distribution of the luminaire. In some cases, the housing has a concave interior surface, and the plurality of solid-state lamps is arranged on the concave interior surface of the housing. In some cases, the housing has a plurality of planar interior surfaces, and the plurality of solid-state lamps is arranged on one or more of the plurality of planar interior surfaces. In some instances, the housing has a convex exterior surface, and the plurality of solid-state lamps is arranged on the convex exterior surface of the housing. In some instances, the housing has a plurality of planar exterior surfaces, and the plurality of solid-state lamps is arranged on one or more of the plurality of planar exterior surfaces. In some cases, the luminaire further includes: one or more heat sinks arranged on an exterior surface of the housing and coupled with the plurality of solid-state lamps through a wall of the housing. In some cases, the luminaire further includes: one or more heat sinks arranged on an interior surface of the housing and coupled with the plurality of solid-state lamps through a wall of the housing. In some instances, the plurality of solid-state lamps are electronically controlled independently of one another by the controller. In some instances, the controller is configured to control at least one of beam direction, beam angle, beam diameter, beam distribution, brightness, and/or color of light emitted by at least one of the plurality of solid-state lamps. In some cases, the controller utilizes at least one of a digital multiplexer (DMX) interface protocol, a Wi-Fi protocol, a digital addressable lighting interface (DALI) protocol, and/or a ZigBee protocol. In some instances, at least one of the plurality of solid-state lamps includes an electro-optic tunable lens, and the controller is configured to control that electro-optic tunable lens. In some cases, at least one of the plurality of solid-state lamps includes a light-emitting diode (LED), and the controller is configured to control that LED. In some instances, at least one of the plurality of solid-state lamps includes at least one of a fixed lens, a reflector, a diffuser, a polarizer, a brightness enhancer, and/or a phosphor material. In some cases, the luminaire is configured to be mounted on a mounting surface comprising a drop ceiling tile, a ceiling, a wall, a floor, or a step. In some cases, the luminaire is configured as a free-standing lighting device.

Another example embodiment provides a luminaire including: a housing having one or more interior surfaces; a plurality of solid-state lamps arranged on the one or more interior surfaces of the housing, wherein light emitted by the plurality of solid-state lamps exhibits a one-to-one mapping of the solid-state lamps to beam spots produced thereby, and wherein at least one of the plurality of solid-state lamps comprises: one or more light-emitting diode (LEDs) populated on a printed circuit board (PCB); and an electro-optic tunable lens optically coupled with the one or more LEDs; and one or more heat sinks arranged on an exterior surface of the housing and coupled with the plurality of solid-state lamps through a wall of the housing. In some cases, the luminaire further includes: a controller communicatively coupled with at least one of the plurality of solid-state lamps and configured to provide pixelated control over light distribution of the luminaire. In some instances, the controller is configured to electronically control the plurality of solid-state lamps independently of one another. In some cases, the controller is populated on the PCB of at least one of the plurality of solid-state lamps and configured to electronically control the one or more LEDs populated on that PCB. In some instances, the luminaire further includes: an electro-optic tunable lens optically coupled with the plurality of solid-state lamps and configured to adjust accumulated light distribution.

Another example embodiment provides a luminaire including: a housing having one or more exterior surfaces; a plurality of solid-state lamps arranged on the one or more exterior surfaces of the housing, wherein light emitted by the plurality of solid-state lamps exhibits a one-to-one mapping of the solid-state lamps to beam spots produced thereby, and wherein at least one of the plurality of solid-state lamps comprises: one or more light-emitting diode (LEDs) populated on a printed circuit board (PCB); and an electro-optic tunable lens optically coupled with the one or more LEDs; and one or more heat sinks arranged on an interior surface of the housing and coupled with the plurality of solid-state lamps through a wall of the housing. In some cases, the luminaire further includes: a controller communicatively coupled with at least one of the plurality of solid-state lamps and configured to provide pixelated control over light distribution of the luminaire. In some cases, the controller is configured to output one or more control signals to electronically control the plurality of solid-state lamps independently of one another. In some instances, the controller is populated on the PCB of at least one of the plurality of solid-state lamps and configured to output one or more control signals to electronically control the one or more LEDs populated on that PCB. In some cases, the luminaire further includes: an electro-optic tunable lens optically coupled with the plurality of solid-state lamps and configured to adjust accumulated light distribution.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A luminaire comprising:

a housing;

a plurality of solid-state lamps arranged on the housing, wherein light emitted by the plurality of solid-state lamps exhibits a one-to-one mapping of the solid-state lamps to beam spots produced thereby;

a controller communicatively coupled with the plurality of solid-state lamps and configured to provide pixelated control over light distribution of the luminaire, wherein the controller is configured to electronically control at least a beam direction of each of the plurality of solid-state lamps independently of one another via an electro-optic tunable lens optically coupled to each of the plurality of solid-state lamps; and a touch-sensitive device configured to communicatively couple to the controller and send an input received by the touch-sensitive device to the controller to individually control each of the plurality of solid-state lamps to thereby provide the pixelated control over light distribution of the luminaire.

2. The luminaire of claim 1, wherein the housing has a concave interior surface, and wherein the plurality of solid-state lamps is arranged on the concave interior surface of the housing.

3. The luminaire of claim 1, wherein the housing has a plurality of planar interior surfaces, and wherein the plurality of solid-state lamps is arranged on one or more of the plurality of planar interior surfaces.

4. The luminaire of claim 1, wherein the housing has a convex exterior surface, and wherein the plurality of solid-state lamps is arranged on the convex exterior surface of the housing.

5. The luminaire of claim 1, wherein the housing has a plurality of planar exterior surfaces, and wherein the plurality of solid-state lamps is arranged on one or more of the plurality of planar exterior surfaces.

6. The luminaire of claim 1 further comprising one or more heat sinks arranged on an exterior surface of the housing and coupled with the plurality of solid-state lamps through a wall of the housing.

7. The luminaire of claim 1 further comprising one or more heat sinks arranged on an interior surface of the housing and coupled with the plurality of solid-state lamps through a wall of the housing.

8. The luminaire of claim 1, wherein the controller is further configured to control at least one of beam angle, beam diameter, beam distribution, brightness, and/or color of light emitted by at least one of the plurality of solid-state lamps.

9. The luminaire of claim 1, wherein the controller utilizes at least one of a digital multiplexer (DMX) interface protocol, a Wi-Fi protocol, a digital addressable lighting interface (DALI) protocol, and/or a ZigBee protocol.

10. The luminaire of claim 1, wherein at least one of the plurality of solid-state lamps includes a light-emitting diode (LED), and wherein the controller is configured to control that LED.

11. The luminaire of claim 1, wherein at least one of the plurality of solid-state lamps includes at least one of a fixed lens, a reflector, a diffuser, a polarizer, a brightness enhancer, and/or a phosphor material.

12. The luminaire of claim 1, wherein the luminaire is configured to be mounted on a mounting surface comprising a drop ceiling tile, a ceiling, a wall, a floor, or a step.

13. The luminaire of claim 1, wherein the luminaire is configured as a free-standing lighting device.

14. A luminaire comprising:

a housing having one or more interior surfaces;

a plurality of solid-state lamps arranged on the one or more interior surfaces of the housing, wherein light emitted by the plurality of solid-state lamps exhibits a one-to-one mapping of the solid-state lamps to beam spots produced thereby, and wherein at least one of the plurality of solid-state lamps comprises:

one or more light-emitting diode (LEDs) populated on a printed circuit board (PCB);

an electro-optic tunable lens optically coupled with the one or more LEDs; and one or more heat sinks arranged on an exterior surface of the housing and coupled with the plurality of solid-state lamps through a wall of the housing; and a touch-sensitive device configured to communicatively couple via a controller to the plurality of solid-state lamps and configured to individually control each of the plurality of solid-state lamps, wherein the controller is configured to electronically control at least a beam direction of each of the plurality of solid-state lamps independently of one another via the electro-optic tunable lens, and wherein the touch-sensitive device is configured to send an input received by the touch-sensitive device to the controller to individually control each of the plurality of solid-state lamps independently of one another.

15. The luminaire of claim 14 further comprising the controller.

16. The luminaire of claim 15, wherein the controller is populated on the PCB of at least one of the plurality of solid-state lamps and configured to electronically control the one or more LEDs populated on that PCB.

17. The luminaire of claim 14 further comprising an electro-optic tunable lens optically coupled with the plurality of solid-state lamps and configured to adjust accumulated light distribution.

18. A luminaire comprising:

a housing having one or more exterior surfaces;

a plurality of solid-state lamps arranged on the one or more exterior surfaces of the housing, wherein light emitted by the plurality of solid-state lamps exhibits a one-to-one mapping of the solid-state lamps to beam spots produced thereby, and wherein at least one of the plurality of solid-state lamps comprises:

one or more light-emitting diode (LEDs) populated on a printed circuit board (PCB);

an electro-optic tunable lens optically coupled with the one or more LEDs; and one or more heat sinks arranged on an interior surface of the housing and coupled with the plurality of solid-state lamps through a wall of the housing; and a touch-sensitive device configured to communicatively couple via a controller to the plurality of solid-state lamps and to individually control each of the plurality of solid-state lamps, wherein at least a beam direction of each of the plurality of solid-state lamps are electronically controlled independently of one another via the electro-optic tunable lens based upon an input received by the touch-sensitive device.

19. The luminaire of claim 18 further comprising the controller.

20. The luminaire of claim 19, wherein the controller is populated on the PCB of at least one of the plurality of solid-state lamps and configured to output one or more control signals to electronically control the one or more LEDs populated on that PCB.

21. The luminaire of claim 18 further comprising an electro-optic tunable lens optically coupled with the plurality of solid-state lamps and configured to adjust accumulated light distribution.

* * * * *